US007544330B2

(12) United States Patent
Ryle

(10) Patent No.: US 7,544,330 B2
(45) Date of Patent: Jun. 9, 2009

(54) MICROPLATE SAMPLE TRACKING SYSTEM

(75) Inventor: Matthew Ryle, Portland, ME (US)

(73) Assignee: IDEXX Laboratories, Inc., Westbrook, MA (US)

( * ) Notice: Subject to any disclaimer, the term of this patent is extended or adjusted under 35 U.S.C. 154(b) by 428 days.

(21) Appl. No.: 11/237,066

(22) Filed: Sep. 28, 2005

(65) Prior Publication Data

US 2007/0072168 A1 Mar. 29, 2007

(51) Int. Cl.
*B01L 9/00* (2006.01)

(52) U.S. Cl. ..... 422/104; 422/99; 422/102; 422/100; 435/305.1; 435/288.4; 356/244; 356/246; 356/440; 250/224

(58) Field of Classification Search ..... None
See application file for complete search history.

(56) References Cited

U.S. PATENT DOCUMENTS

| | | | | |
|---|---|---|---|---|
| 4,563,096 | A * | 1/1986 | Chidlow et al. | 356/440 |
| 4,678,894 | A * | 7/1987 | Shafer | 235/375 |
| 4,692,609 | A * | 9/1987 | Pettersson | 250/221 |
| 4,701,754 | A | 10/1987 | Provonchee | 340/815.03 |
| 5,380,493 | A | 1/1995 | Chavez et al. | |
| 6,340,588 | B1 | 1/2002 | Nova et al. | 435/287.1 |
| 6,372,428 | B1 | 4/2002 | Nova et al. | 435/6 |
| 6,567,163 | B1 | 5/2003 | Sandstrom | 356/317 |
| 6,713,298 | B2 | 3/2004 | McDevitt et al. | 435/287.8 |
| 6,743,581 | B1 | 6/2004 | Vo-Dinh | 435/6 |
| 6,803,999 | B1 | 10/2004 | Gordon | 356/73 |
| 6,806,954 | B2 | 10/2004 | Sandstrom | 356/317 |
| 2005/0025357 | A1 * | 2/2005 | Landwehr et al. | 382/170 |
| 2005/0046847 | A1 | 3/2005 | Cromwell et al. | |
| 2005/0248958 | A1 * | 11/2005 | Li | 362/555 |
| 2006/0044792 | A1 * | 3/2006 | Dallas et al. | 362/184 |
| 2008/0062706 | A1 * | 3/2008 | Feldmeier | 362/459 |

FOREIGN PATENT DOCUMENTS

| | | |
|---|---|---|
| EP | 0 210 148 | 6/1987 |
| WO | WO 81/03223 | 11/1981 |

OTHER PUBLICATIONS

International Search Report and Written Opinion issued in corresponding PCT application, application No. PCT/US2006/037506 dated Feb. 16, 2007.

Lavergne, French Publication No. FR2649511, Device for processing microtitration plates, Jan. 11, 1991 abstract only.

* cited by examiner

*Primary Examiner*—Jill Warden
*Assistant Examiner*—P. Kathryn Wright
(74) *Attorney, Agent, or Firm*—McDonnell Boehnen Hulbert & Berghoff LLP

(57) ABSTRACT

The invention provides sample tracking systems and methods. A sample tracking system can comprise a plate having a plurality of sample wells and an apparatus for illuminating each individual sample well, wherein the manner with which the sample well is illuminated can track the loading of the sample components to the sample wells.

5 Claims, 4 Drawing Sheets

MICROPLATE SAMPLE TRACKING SYSTEM

BACKGROUND

In many scientific disciplines successful research depends largely on generating voluminous amounts of experimental data for analysis. With the advent of microarrays, autosamplers, and microfluidics, the research laboratory has become largely automated and reduced in size. Nevertheless, accuracy and precision in sample preparation and measurement remain as critical as ever. A problem that has remained in the art, whether due to the pure bulk of sample analysis, or the ever-shrinking scale of the analytical laboratory, or both, is that laboratory researchers and technicians can incorrectly prepare sample reactions. Frequently this occurs during the preparation of multi-well reaction plates, where sample components are in loaded in the incorrect well (e.g., a well is skipped, a sample component is added twice, etc.). See, e.g., U.S. Pat. No. 4,701,754. Compositions and methods are needed in the art for ensuring proper preparation and analysis of sample components.

SUMMARY OF THE INVENTION

One embodiment of the invention provides an auto-tracking assay system. The system comprises a plurality of sample wells; an array of indicator lights, wherein each indicator light in the array of indicator lights corresponds to an individual sample well of the plurality of sample wells; a detection system for determining when a sample component has been introduced into one or more sample wells of the plurality of sample wells; and a processor that receives inputs from the detection system and generates control signals for the array of indicator lights. The processor can further generate control signals for an audible signal. The detection system can send an input signal to the processor when one or more sample wells of the plurality of sample wells has received a sample component. The input signal can contain the specific location of the one or more sample wells. The processor can output a first control signal to the array of indicator lights that causes the corresponding indicator light in the array of indicator lights to change states. The detection system can send an input signal to the processor when one or more sample wells of the plurality of sample wells has received a sample component, wherein the input signal contains the specific location of the one or more sample wells, and wherein the processor outputs a control signal to activate an audible signal. The processor can determine the next one or more sample wells of the plurality of sample wells to receive a sample component, wherein the processor outputs a second control signal to the array of indicator lights, and wherein the second signal causes the indicator light that corresponds to the next one or more sample wells to change states.

Each indicator light (112, 114, and/or 116) in the array of indicator lights can be configured to output a first color, wherein the first color is associated with one or more sample wells to be loaded. Each indicator light (112, 114, and/or 116) in the array of indicator lights can comprise a first light source 112, wherein said first light source is configured to output said first color. Each indicator light (112, 114, and/or 116) in the array of indicator lights can be configured to output a second color, wherein the second color is associated with a sample well that has been loaded with a first sample component. Each indicator light (112, 114, and/or 116) in the array of indicator lights can be configured to output a third color, wherein the third color is associated with a sample well that has been loaded with a second sample component. Each indicator light (112, 114, and/or 116) in the array of indicator lights can comprise a fiber optic element that is capable of displaying both said first color and said second color. Each indicator light (112, 114, and/or 116) in the array of indicator lights can comprise a fiber optic element that is capable of displaying the first color, the second color, and the third color. Each indicator light (112, 114, and/or 116) in the array of indicator lights can comprise a first light source 112 and a second light source 114, said first light source 112 configured to output said first color and second light source 114 configured to output said second color. Each indicator light (112, 114, and/or 116) in the array of indicator lights can comprise a first light source 112, a second light source 114, and a third light source 116, wherein said first light source 112 is configured to output said first color, said second light source 114 is configured to output said second color, said third light source 116 is configured to output said third color. The first light source 112 and second light source 114 can comprise a first light emitting diode (LED) and a second LED, respectively. The first light source 112, the second light source 114, and the third light source 116 comprise a first LED, a second LED, and a third LED, respectively. Additional LEDs or alternate indicators can be used as well.

The plurality of wells can be laid out in a two-dimensional array on an at least partially transparent plate, wherein the array of indicator lights has the same dimension as the plurality of wells. The partially transparent plate can be positioned above the array of indicator lights such that each sample well of the plurality of wells sits substantially above a corresponding indicator light in the array of indicator lights.

The detection system can comprise at least one element suitable for detecting an event within the well. The element can include, for example, an infrared laser, refractive index probe or conductivity probe and related detectors. In one embodiment, there can be an infrared laser and at least one infrared detector. The infrared laser can direct light through the individual sample wells of the plurality of wells to at least one infrared detector. A change in intensity of infrared light received by the detector between an unloaded sample well can be used to determine if a sample component has been introduced into a sample well. A change of intensity of infrared light received by the detector between an unloaded and a loaded sample well can be measured across an infrared spectrum. The detection system can comprise a functional button that a user can press to indicate that one or more sample wells of the plurality of wells has received a sample component.

The system can further comprise a database that is accessible by the processor and can be used to store relevant data corresponding to sample wells; a data input device that allows a user to input relevant data corresponding to sample wells into the database; and a video display that can be used to display relevant data corresponding to sample wells. The data input device can comprise a barcode reader or a keyboard.

The system can further comprise a loading system for loading sample components into individual sample wells. The loading system can be automatic. The loading system can receive loading control signals from the processor, and the loading control signals can direct the loading system to the next one or more sample wells to be filled.

Another embodiment of the invention provides an auto-tracking assay system comprising a plurality of sample wells; a light source mounted onto a self-advancing tracking system, wherein one or more wells of the plurality of sample wells can be illuminated by the light source; a detection system for detecting when a sample component has been introduced into one or more sample wells of the plurality of sample wells; and a processor that receives inputs from the detection system and generates control signals for the array of indicator lights. The processor can further generate control signals for an audible signal.

Still another embodiment of the invention provides a method for automatically tracking assay samples. The method comprises illuminating a first one or more sample wells in an assay plate with a first color; determining the loading of a first sample component into the first one or more sample wells; and illuminating the first one or more sample wells in the assay plate with a second color, once the first sample component has been added to the first one or more sample wells. The method can further comprise activating an audible signal once the first sample component has been added the first one or more samples well. The method can further comprise determining the loading of a second sample component into the first one or more sample wells and illuminating the first one or more sample wells with a third color, once the second sample component has been added to the first one or more sample wells. The method can further comprise activating an audible signal once the second sample component has been added to the first one or more sample wells. The method can further comprise illuminating a second one or more sample wells with the first color once the second sample component has been added to the first one or more sample wells. The method can further comprise inputting data associated with a first sample component to be put into the first one or more sample wells, after illuminating the first sample one or more wells; storing data associated with the first sample component in a database; and detecting the inputting and storing of data associated with the first sample component.

The current invention therefore provides a device and method for eliminating sample inaccuracy due to improper sample preparation by keeping an accurate and precise record of the status of each sample well. Thus, this device would minimize or abolish the problem of improperly prepared samples, which could lead to inaccurate experimental data, delay in data analysis, and inability to independently verify data.

BRIEF DESCRIPTION OF THE DRAWINGS

Exemplary embodiments of the invention are described below in conjunction with the appended figures, wherein like reference numerals refer to like elements in the various figures, and wherein.

DETAILED DESCRIPTION

1. Brief Overview

The invention is useful for any laboratory application that uses microplate arrays, for example, 96-well ELISA assays as well as any assay that uses multiple samples. While the invention may be particularly well-suited to certain applications, it is not limited to any particular scientific field, discipline, or industry. In particular researchers can use the invention to rapidly generate sample ID lists for population studies that would automatically be exported to a database, spreadsheet or electronic lab notebook for accurate sample identification.

Figure 1:
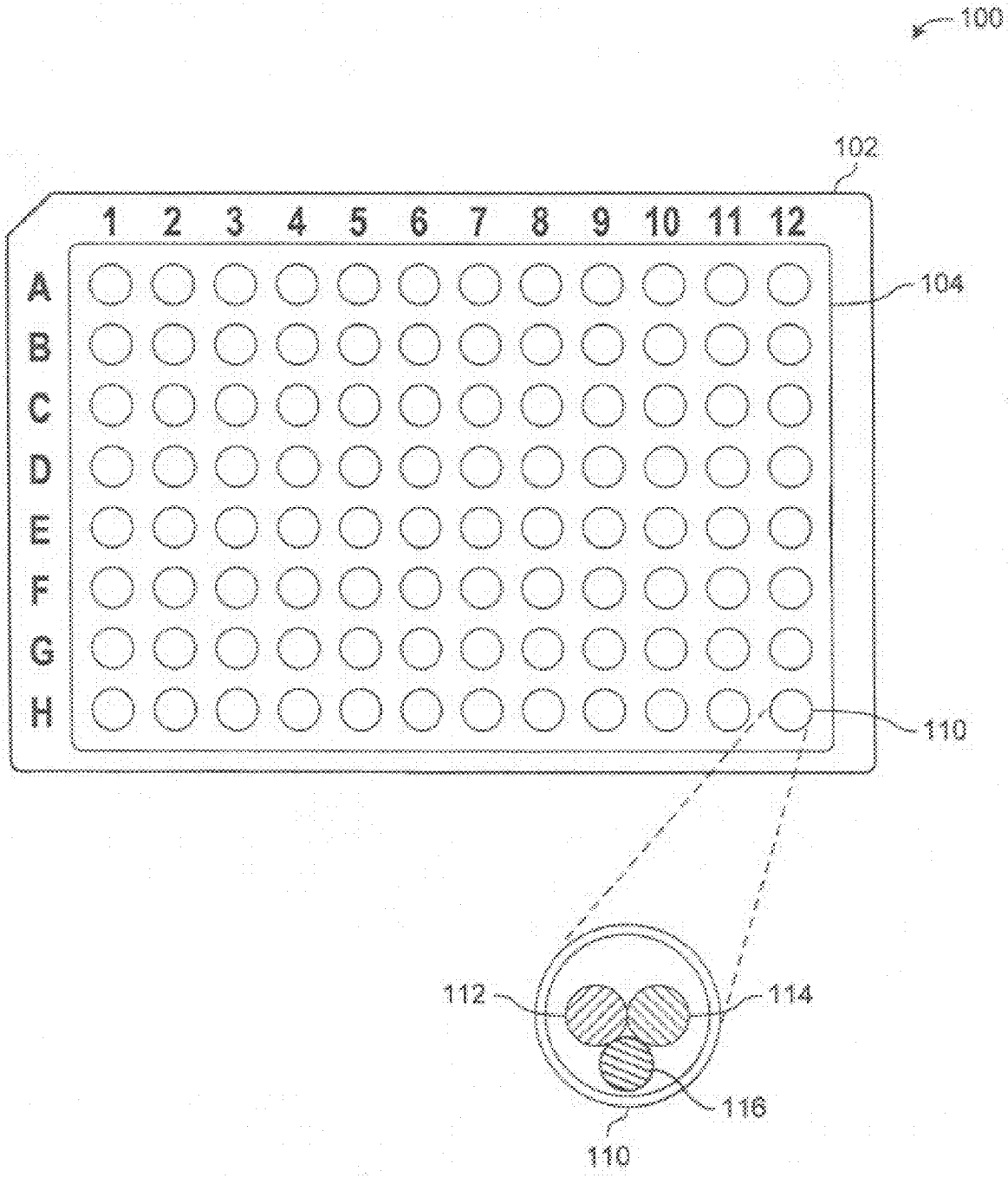
FIG. 1 is an illustration of a series of microplate array sample wells comprising an array of light sources contained in a transparent housing underneath the microplate array, according to an exemplary embodiment.

In one embodiment, the invention comprises an auto-assay system comprising an 8 ×12 array of indicator lights 104 that is configured to sit underneath a platform that holds a 96-well microplate 102, such that one or more indicator lights in the 8×12 array of indicator lights corresponds to (i.e., sits substantially below) a single well 110 of the 96-well microplate. See, e.g., FIG. 1 showing an assay plate arranged over an array of indicator lights 100. In another embodiment, the invention comprises a light source mounted on a movable mechanical arm, such that the light source may be positioned over a large array of points in order to illuminate a single object, specifically a sample well in a microplate array. In another embodiment and in addition to either of the embodiments above, the invention further comprises a barcode reader and wireless communication to a processor so that the invention can be monitored and/or used remotely (e.g., fume hood, lab bench).

As a simple illustration of how one embodiment of the invention may operate, a 96-well microplate is placed above the array of indicator lights. An indicator light in the array of indicator lights (e.g., the one located underneath well A5) would change states (i.e., turn on or off, change color, etc.) queuing the researcher to enter a sample name. This sample name could be scanned using the barcode reader or entered manually by the user. Once the sample name is entered, the indicator light again changes states (e.g., color change from red to green) indicating that a sample component is to be added to that particular sample well. Once the sample component is loaded, the same process is repeated for the next sample well (e.g., A6) until all the desired sample wells are loaded. A complete list of all sample wells, including all sample components can be exported to a spreadsheet or database program to aid in data analysis and management. The full scope of the invention is described below.

2. Light Source Array

As briefly described above, one aspect of the invention comprises an array of light sources that may be housed underneath an assay plate. The light sources may be arranged into an 8×12 array in order to correspond to each sample well of a standard 96-well microplate. Alternatively, the light sources may be arranged into a larger or smaller array in order to correspond to differently arranged microplates. As will be seen below, the light source array may also be compatible with assay plates having irregular geometries or having dimensions smaller than the 8×12 array.

A given indicator light in the array may be in close proximity to a sample well of the assay plate, and identifies (or is associated with) a specific well and its contents. The layout of the indicator lights in the array may be varied in their geometric pattern and spacing, as determined by the geometry of the assay plates used in the assay, or in order to create a more dense array of lights that are versatile in their configurability and adaptation to multiple assay plates. By changing the state of an indicator light (e.g., turning on/off, blinking sequence, change in color, etc.) through automatic or manual means, a technician can easily and quickly identify the status of any particular well in the assay plate. The state of an indicator light can be directed by a processor that generates control signals for the array of indicator lights.

A variety of assay plates may be useful in conjunction with this embodiment of the invention. Assay plates can be made of any common material, including glass and plastic; however plastics are preferred. Any assay plate that is commercially available can be used with the invention, as long as it has sufficient transparency and is able to house, or sit above, the array of indicator lights of the invention. An assay plate has sufficient transparency if it allows for observation or detection of the indicator lights through its material. Typically, the assay plates are transparent and have little to no opaque character.

One can use any of a variety of indicator light arrangements in the invention. In one embodiment, a single light emitting diode (LED) may be utilized for each indicator light. In this configuration, a single LED may be used to illuminate the sample well of interest. Alternatively, one or more LEDs may be flashed in order to indicate an error or change of state in one or more of the sample wells. The transparent or partially transparent assay plate may then be placed above the indicator light array for tracking purposes. For example, the indicator light array may comprise an array of red LEDs, with a single LED corresponding to each sample well in the assay plate placed above it. The next sample well to be loaded may be illuminated with the red LED. Additionally, once a sample is loaded the corresponding illuminated LED may blink or flash briefly in order to indicate a change in state prior to the next sample well being illuminated.

In another embodiment, each indicator light may comprise two differently colored LEDs placed in close proximity to each other in a single transparent or slightly opaque housing. The only requirement of the housing is that it is sufficiently transparent (opacity is acceptable) so that light emitted by the LEDs is observable. The location and placement of the LEDs in the housing can make it appear as if the two LEDs are a single LED light. Together, the housing and both LEDs form the indicator light. When one LED is switched on, the indicator light outputs the color of the first LED. When a second LED is switched on and the first LED turned off, the indicator light indicates the color of the second LED. When both LED's are switched on, the indicator light outputs a color which is the combination of the two LEDs. Thus, if the first LED is red and the second LED is green, the combination of the two LED's together will make indicator light appear as a third yellow-hued color. This may allow for the indication of multiple states, with a different color or combination of colors corresponding to each sample well state. For example, a sample well may be illuminated with a red LED in order to indicate that it is the next well to be loaded and is currently empty, a yellow-hue generated by both red and green LEDs in an indicator light may indicate that the sample well has been loaded but no information has been entered into the database for the corresponding sample well, and a sample well illuminated by a green LED may indicate that the well contains a sample and that the corresponding information for the sample has been entered into the database. In this method, all completed sample wells may remain illuminated by a green LED, with the next sample well to be filled illuminated by either a red or yellow hue.

In another embodiment the lights can change states when a second, third, fourth, etc. sample component is added to the same sample well. For example, an indicator light can change states when a first sample component, e.g., a biological sample, is added to a well. The indicator light can again change states when a second sample component, e.g., a diluent is added to the well. The indicator light can again change states when a third sample component, e.g., an enzyme, is added to the well and so on.

In another embodiment, the indicator light comprises one or more fiber optics. Fiber optics allow for a single light source per well, as the light color that passes through the fiber optic is variable and controllable by the user. The use of fiber optics to realize the indicator lights may allow the indicator light array to be used in conjunction with a larger variety of microplates, due to the relatively small size of the fiber optic terminations. This may be permit the indicator light array to be used with a higher density of sample wells, where a microplate has smaller sample wells, or sample wells oriented more closely together or both. Furthermore, the use of fiber optic devices to realize each indicator light may permit the indicator light array to be utilized with a larger variety of sample assays. Certain samples or reactions may be light sensitive, and the indicator light array may be configured to use wavelengths that are neither destructive to the samples nor obstructive to any reactions being observed in the assay.

In other embodiments, the indicator lights of the invention are designed so that any change in state of the indicator light determines the status of the samples in the assay array. Such changes in state include, as briefly described above, turning on/off and blinking sequences. These sequences may be simple cycling of on/off states, or may comprise complicated sequences such as variably numbered flashes followed by a sustained on or off state in order to designate, for example, a particular error or status code.

An assay system may also comprise a processor that generates control signals for an audible signal. The audible signal, for example, a buzzer such as a peizo buzzer, can be generated at any point in the assay. For example, an audible signal may sound when a next sample well is to be loaded or before or after the addition of a sample component.

As described above, the number of sample wells in the assay plates may vary widely. Nevertheless, the invention requires a one well to one indicator light ratio, so well number is limited by the ability to orient the indicator lights properly. As a result, a sample containing multiple indicator lights in a tightly-spaced arrangement may be used with a larger variety of assay plates. In a preferred embodiment the assay plate is a common 96-well assay plate (8×12 well arrangement).

3. Mechanical Tracking System

Figure 2:
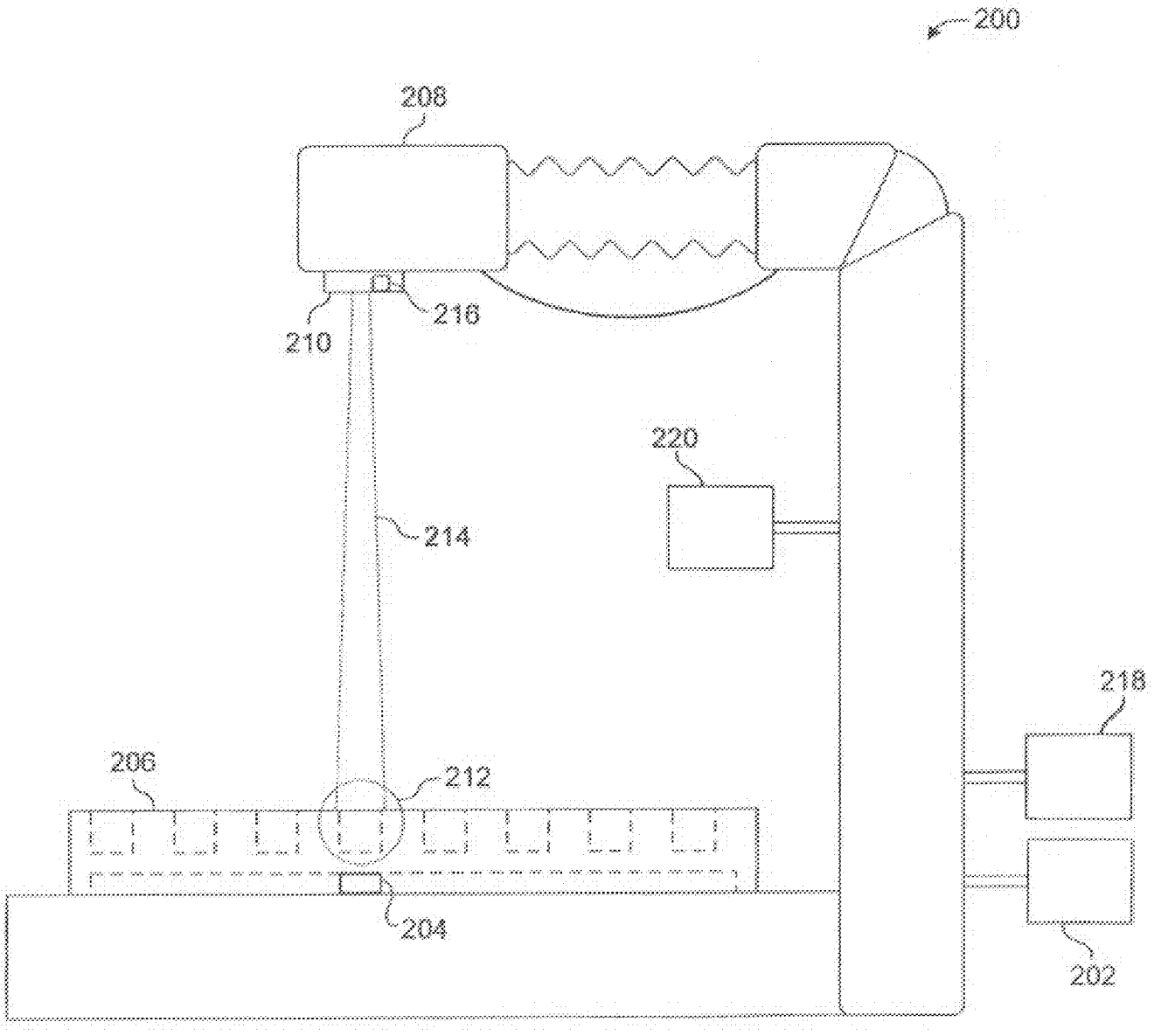
FIG. 2 is an illustration of a system for tracking samples loaded into a series of microplate array sample wells comprising a mechanical robotic arm with a light source for illuminating individual sample wells, according to an exemplary embodiment.

In another embodiment, the indicator light is located on the arm of a self-advancing tracking system, such as are known in the art. See e.g., FIG. 2 showing an auto-tracking assay system 200. In this embodiment, the well to be filled 212 is illuminated 214 by the indicator light 210 on the arm 208, which may be positioned above the assay plate 206. The arm may be advanced automatically, or it may be advanced by the user, upon the successful addition of a sample component to each individual well. This allows for either automated assays, or for user-modifiable assays.

The indicator light used in the arm of the self-advancing tracking system may preferably be a laser source, which may permit a single sample well to be illuminated due to its small lateral spread. Alternatively, other light sources with limited lateral spread may be utilized as the indicator light source.

With the indicator light being placed above the assay plate, this system is not restricted to transparent or partially transparent plates. In a preferred embodiment, the assay plate may be substantially reflective so that a user may easily observe the illumination of a single sample well.

In another embodiment, the arm may further comprise a means for addition of well components, such as are known in the art. This may allow a user to quickly and easily determine the state of a sample well during an assay by visually observing how a sample well is illuminated by the indicator light.

In a further embodiment, the arm may comprise a means for detecting addition of sample component to the sample well, such as an infrared beam, flow monitor, drop counter, or the like or any combination thereof. By being able to detect the addition of a sample, the arm may be a fully automated system that may be initially configured by a user and set to run through an assay with little or no user interaction.

4. System Configuration

In order to accommodate a variety of assay plates, the indicator light array may be configured either manually or automatically to adapt to the number and orientation of sample wells in a standard or custom assay plate. This may be accomplished through an external control processor and database, where the database contains the orientation, spacing, and dimensions of various standard assay plates. Additionally, this database may receive inputs that describe customized assay plates.

Figure 3:
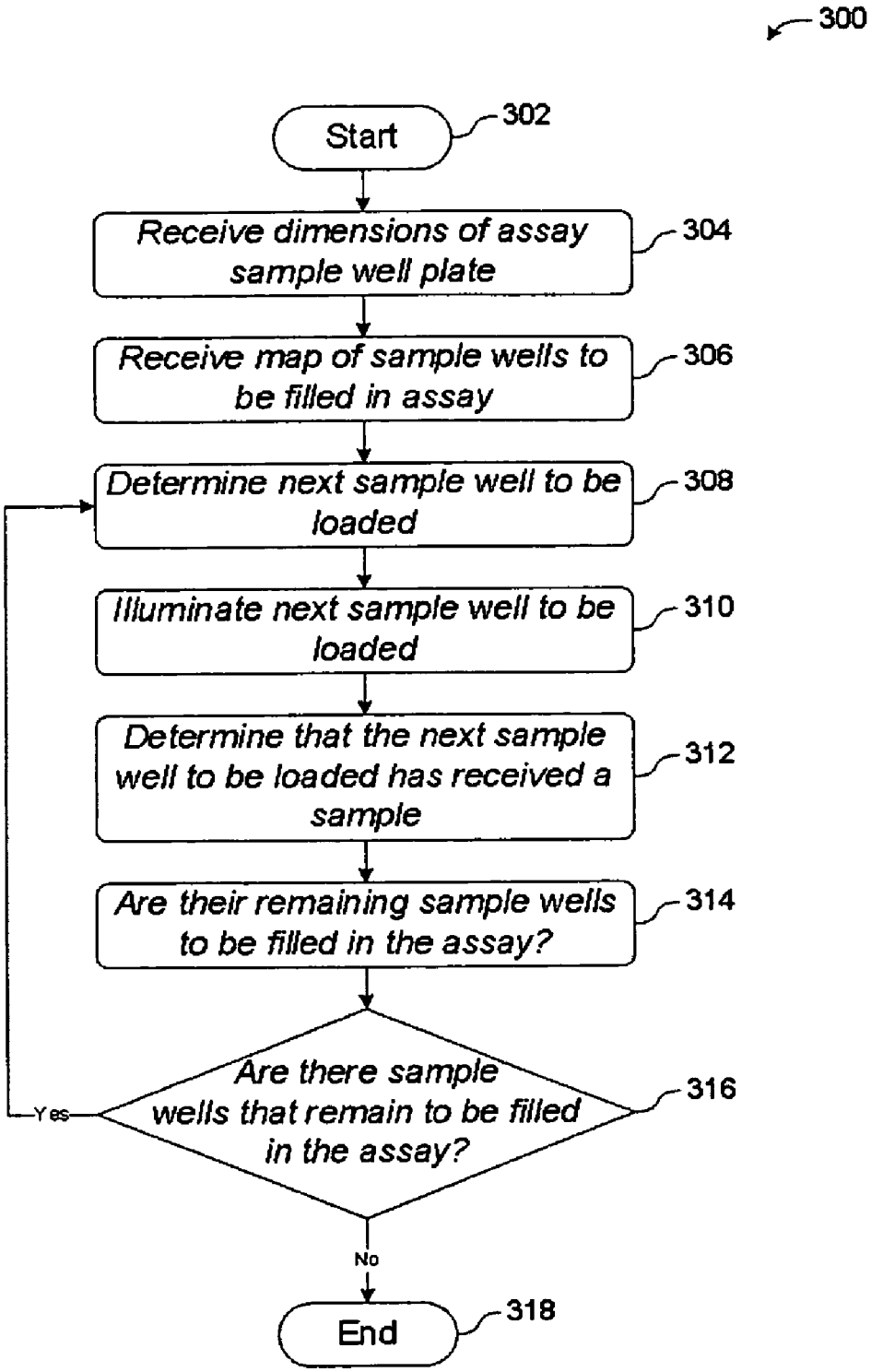
FIG. 3 is a process diagram illustrating a method for tracking samples loaded into a series of mircoplate array sample wells by illuminating individual samples wells, according to an exemplary embodiment.
Figure 4:
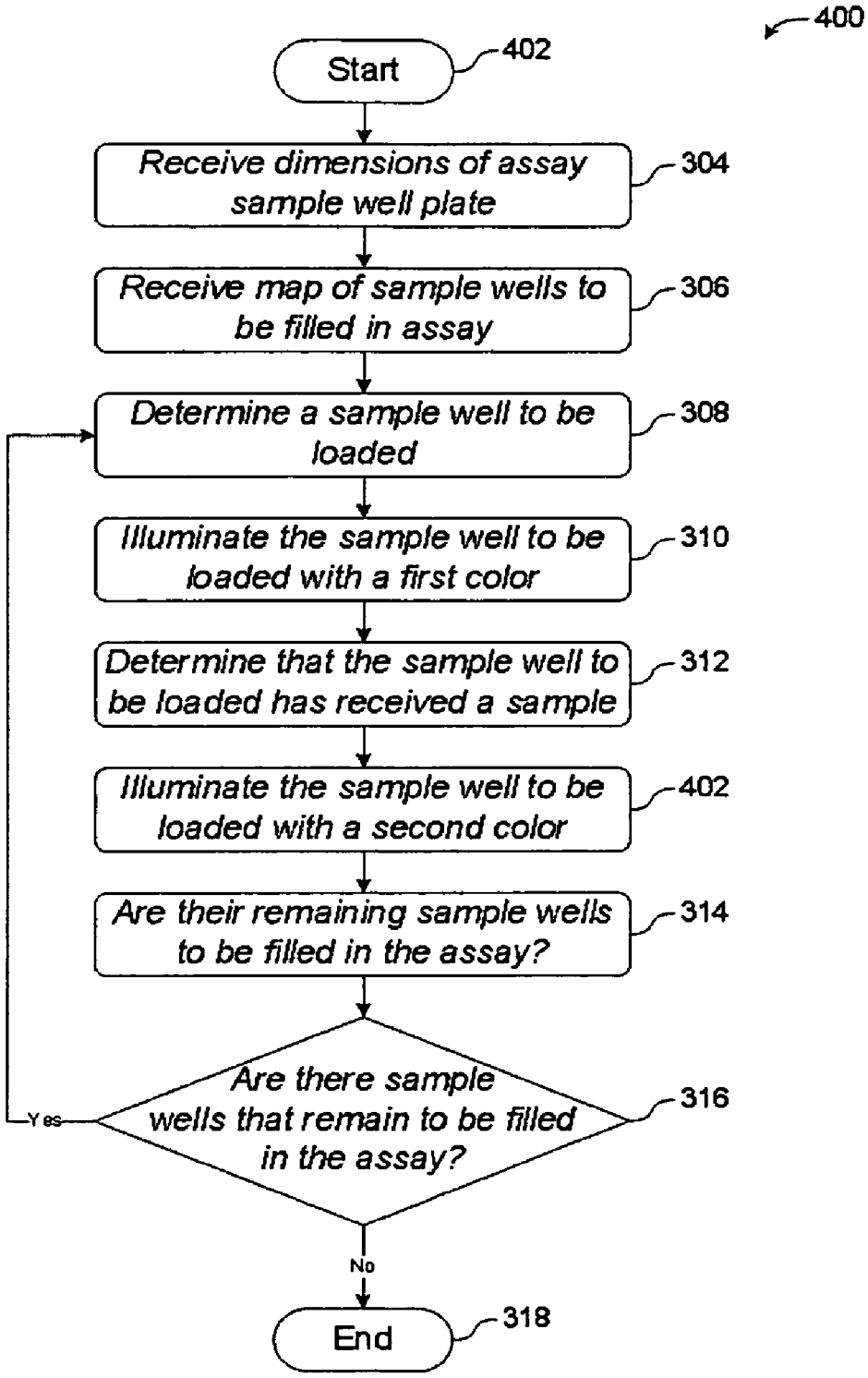
FIG. 4 is a process diagram illustrating a method for tracking samples loaded into a series of mircoplate array sample wells by illuminating individual samples wells, according to an exemplary embodiment.

When running an assay, a user may first designate the type of assay plate that is to be used. See FIGS. 3 and 4. If it is a standard assay plate, the user may select the plate from those available in the database; if the plate is customized or otherwise not available in the database, the user may create a new assay plate entry by designating such parameters as the size of the sample wells, geometry of the sample wells, spacing of the sample wells, geometry of the sample well array, and the size of the sample well array. Depending on the capabilities of the sample tracking system, the database entry may either be accepted or rejected. For example, if the microplate sample tracking system comprises a 4×6 LED array and an assay plate entry corresponding to an 8×12 array is entered, the entry may be rejected. In another example, a system may be rejected if the physical geometry of the plate is larger than the geometry supported by the microplate sample tracking system, whether it is larger than the LED or fiber optic array, or outside of the physical capabilities of the mechanical arm of the self-advancing system.

Once an assay plate has been designated, the user may select the number of samples and which sample wells should be used for the assay. Because an assay may not use all of the sample wells, or a because a special geometry may be required for the assay (e.g., every other sample well, only one row of sample wells, only one column of sample wells, etc.), a user may wish to specifically state the sample wells to be used and the filling progression that these sample wells should follow.

Additionally, the user may select the intermediate states attributed to each sample well and the requirements necessary for each sample well before a new sample well is illuminated. For example, the user may indicate that a sample well is only complete when it has both been filled with a sample and corresponding data has been entered into an assay database. If available, the user may also select which colors to use with each intermediate state, if any, of each sample well.

After both the assay plate has been selected and the method for filling the sample wells in the assay plate have been determined, the user may then store the assay-specific parameters for subsequent similar assays. Subsequently, the user may then simply select the assay that is desired without having to re-configure the entire experiment from scratch.

With the proper assay parameters selected, the user may then load the corresponding assay plate either above the indicator light array, or onto a staging platform below the self-advancing arm. The system may then illuminate the first sample well in the assay and await either user input or the detection of a loaded sample well.

The processor 202 can receive inputs from the detection system and generate control signals for the array of indicator lights. For example, after the first sample well (or set of sample wells, e.g., a row of wells) is loaded, the processor may check the assay parameters and determine the next sample well(s) to be illuminated and its corresponding state. The system may then progress through the rest of the assay until all sample wells designated by the assay parameters are filled. The detection system can send an input signal to the processor when a sample well(s) of the plurality of sample wells has received a sample component. The input signal can contain the specific location of the sample well. The processor can then output a first control signal to the array of indicator lights that causes the corresponding indicator light in the array of indicator lights to change states. The processor can also output a separate control signal to activate an audible signal. The processor can also determine the next sample well(s) of the plurality of sample wells to receive a sample component. The processor can output a second control signal to the array of indicator lights. The second control signal can cause the indicator light that corresponds to the next sample well(s) to change states.

A system can also comprise a database that is accessible by the processor and can be used to store relevant data corresponding to sample wells. A system can also comprise a data input device, such as a barcode reader or a keyboard that allows a user to input relevant data corresponding to sample wells into the database. A system can further comprise a video display that can be used to display relevant data corresponding to sample wells.

A system of the invention can also comprise a loading system 220 for loading sample components into individual sample wells. The loading system can be automatic, such as pipetting robotic arms, or manual. An automatic loading system can receives loading control signals from the processor, and the loading control signals can direct the loading system to the next sample well to be filled.

5. Detection System

A system of the invention can comprise a detection system for determining when a sample component has been introduced into a sample well or a set of sample wells (e.g., a row of wells), such as a sensor that can detect the addition of a sample to well(s). Such a sensor can be based on detection of refractive index, liquid height in a well, or inert dye molecules added to a sample component. Detection can also be based on sensing drops of liquid added to the well or detection of pipette dispensement. A detection system can also comprise a functional button 218 that a user can press to indicate that sample well(s) have received a sample component.

In one embodiment of the invention, the detection system comprises an infrared laser and at least one infrared detector. FIG. 2 demonstrates one type of arrangement of positioning of an infrared laser 216 and one infrared detector 204 comprising one embodiment of a detection system. The infrared laser directs light through the individual sample wells to at least one infrared detector. A change in the intensity of infrared light received by the detector between an unloaded sample well and a loaded sample well can be used to determine if a sample component has been introduced into a sample well. A change of intensity of infrared light received by the detector between an unloaded and a loaded sample well can be measured across an infrared spectrum.

6. Barcode Reader

In one aspect, the invention relates to a sample tracking system that comprises a barcode reader. The barcode reader can be any barcode reader as is known in the art, but is preferably one that is convenient to implement for the sample tracking system of the invention. Considerations as to size, mobility, and accessibility by the operator can determine whether a particular barcode reader is more appropriate for the particular application.

When used in conjunction with the indicator light array or self-advancing system, the barcode reader may be used to quickly and easily enter information corresponding to a sample into an assay database. The user may have a list of barcode entries, with each entry containing specific parameters of each sample well entry. When a sample is loaded into a sample well of the assay plate, the indicator light illuminating the sample well may change states to indicate that a data entry corresponding to the sample in the sample well is requested. The user may then scan the appropriate barcode entry for the sample well, which the system may detect, after which the tracking system may change the state of the indicator light illuminating the sample well, and then selectively advance to the next sample well in the assay.

In further embodiments the invention can be used with a wireless communication connection to a computer. This allows for use of the invention in any remote location, for example, a fume hood, a cold room, a clean room, on various laboratory benchtops, etc. The computer can control the addition of reaction components and/or the sequence of the indicator lights. This embodiment can be combined with a sample tracking system and an auto-advancing mechanism for nearly total automation of the assay, while allowing for manual observation or manipulation of the assay.

All patents, patent applications, and other scientific or technical writings referred to anywhere herein are incorporated by reference in their entirety. The methods and compositions described herein as presently representative of preferred embodiments are exemplary and are not intended as limitations on the scope of the invention. Changes therein and other uses will be evident to those skilled in the art, and are encompassed within the spirit of the invention. The invention illustratively described herein suitably can be practiced in the absence of any element or elements, limitation or limitations that are not specifically disclosed herein. Thus, for example, in each instance herein any of the terms "comprising", "consisting essentially of", and "consisting of" can be replaced with either of the other two terms. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by embodiments and optional features, modification and variation of the concepts herein disclosed are considered to be within the scope of this invention as defined by the description and the appended claims.

In addition, where features or aspects of the invention are described in terms of Markush groups or other grouping of alternatives, those skilled in the art will recognize that the invention is also thereby described in terms of any individual member or subgroup of members of the Markush group or other group.

I claim:

1. An auto-tracking assay system comprising:

a plurality of sample wells;

an array of indicator lights, wherein each indicator light in the array of indicator lights corresponds to an individual sample well of the plurality of sample wells; and wherein each indicator light in the array of indicator lights is configured to output a first color and a second color, wherein each indicator light in the array of indicator lights comprises a fiber optic element that is capable of transmitting both said first color and said second color, wherein the first and second colors are different, wherein the first color is associated with one or more sample wells to be loaded; and wherein the second color is associated with a sample well that has been loaded with a first sample component;

a detection system for determining when a sample component has been introduced into one or more sample wells of the plurality of sample wells, wherein the detection system comprises an infrared laser and at least one infrared detector, wherein the infrared laser directs light through the individual sample wells of the plurality of wells to at least one infrared detector, and wherein a change in intensity of infrared light received by the detector between an unloaded sample well can be used to determine if a sample component has been introduced into a sample well; and a processor that receives inputs from the detection system and generates control signals for the array of indicator lights.

2. An auto-tracking assay system comprising:

a plurality of sample wells;

an array of indicator lights, wherein each indicator light in the array of indicator lights corresponds to an individual sample well of the plurality of sample wells; and wherein each indicator light in the array of indicator lights is configured to output a first color, a second color, and a third color, wherein the first, second and third colors are different; wherein each indicator light in the array of indicator lights comprises a fiber optic element that is capable of transmitting the first color, the second color, and the third color;

a detection system for determining when a sample component has been introduced into one or more sample wells of the plurality of sample wells, wherein the detection system comprises an infrared laser and at least one infrared detector, wherein the infrared laser directs light through the individual sample wells of the plurality of wells to at least one infrared detector, and wherein a change in intensity of infrared light received by the detector between an unloaded sample well can be used to determine if a sample component has been introduced into a sample well; and a processor that receives inputs from the detection system and generates control signals for the array of indicator lights, wherein the detection system sends an input signal to the processor when one or more sample wells of the plurality of sample wells has received a sample component, wherein the input signal contains the specific location of the one or more sample wells, and wherein the processor outputs a first control signal to the array of indicator lights that causes the corresponding indicator lights in the array of indicator lights to change states.

3. An auto-tracking assay system comprising:

a plurality of sample wells, wherein the plurality of wells is on an at least partially transparent plate;

an array of indicator lights, wherein each indicator light in the array of indicator lights corresponds to an individual sample well of the plurality of sample wells; and wherein each indicator light in the array of indicator lights is configured to output a first color and a second color, wherein the first and second colors are different;

a detection system for determining when a sample component has been introduced into one or more sample wells of the plurality of sample wells wherein the detection system comprises an infrared laser and at least one infrared detector, wherein the infrared laser directs light through the individual sample wells of the plurality of wells to at least one infrared detector, and wherein a change in intensity of infrared light received by the detector between an unloaded sample well can be used to determine if a sample component has been introduced into a sample well; and a processor that receives inputs from the detection system and generates control signals for the array of indicator lights.

4. The auto-tracking assay system of claim 3, wherein the change of intensity of infrared light received by the detector between an unloaded and a loaded sample well is measured across an infrared spectrum.

5. An auto-tracking assay system comprising:

a plurality of sample wells;

an array of indicator lights, wherein each indicator light in the array of indicator lights corresponds to an individual sample well of the plurality of sample wells; wherein each indicator light in the array of indicator lights is configured to output a first color and a second color, wherein the first and second colors are different;

a detection system for determining when a sample component has been introduced into one or more sample wells of the plurality of sample wells, wherein the detection system comprises an infrared laser and at least one infrared detector, wherein the infrared laser directs light through the individual sample wells of the plurality of wells to at least one infrared detector, and wherein a change in intensity of infrared light received by the detector between an unloaded sample well can be used to determine if a sample component has been introduced into a sample well;

a processor that receives inputs from the detection system and generates control signals for the array of indicator lights; and a loading system for loading sample components into individual sample wells, wherein the loading system is automatic, and wherein the loading system receives loading control signals from the processor, and wherein the loading control signals direct the loading system to the next one or more sample wells to be filled.

* * * * *

UNITED STATES PATENT AND TRADEMARK OFFICE

CERTIFICATE OF CORRECTION

PATENT NO. : 7,544,330 B2
APPLICATION NO. : 11/237066
DATED : June 9, 2009
INVENTOR(S) : Ryle It is certified that error appears in the above-identified patent and that said Letters Patent is hereby corrected as shown below:

On the Title Page, Item (73) "Westbrook, MA" should read --Westbrook, ME--.

Signed and Sealed this

Seventh Day of July, 2009

JOHN DOLL
*Acting Director of the United States Patent and Trademark Office*